US010076202B1

(12) United States Patent
Nickoles

(10) Patent No.: US 10,076,202 B1
(45) Date of Patent: Sep. 18, 2018

(54) APPARATUS TO HELP DISABLED PERSONS PULL UP PANTS AND UNDERPANTS SIMULTANEOUSLY AFTER USING THE TOILET

(71) Applicant: Carol Louise Nickoles, Colliers, WV (US)

(72) Inventor: Carol Louise Nickoles, Colliers, WV (US)

( * ) Notice: Subject to any disclaimer, the term of this patent is extended or adjusted under 35 U.S.C. 154(b) by 106 days.

(21) Appl. No.: 15/241,699

(22) Filed: Aug. 19, 2016

Related U.S. Application Data

(60) Provisional application No. 62/207,424, filed on Aug. 20, 2015.

(51) Int. Cl.
*A47G 25/90* (2006.01)

(52) U.S. Cl.
CPC ..... *A47G 25/90* (2013.01)

(58) Field of Classification Search
CPC ..... A47G 25/90
See application file for complete search history.

(56) References Cited

U.S. PATENT DOCUMENTS

| | | | | |
|---|---|---|---|---|
| 5,884,371 | A * | 3/1999 | Huggins | A41F 19/00 24/298 |
| 6,044,491 | A | 4/2000 | Emery | |
| 8,087,707 | B1 | 1/2012 | Hawkins | |
| 2004/0034902 | A1 | 2/2004 | Yturria | |
| 2005/0205619 | A1 | 9/2005 | Morel | |
| 2009/0039118 | A1* | 2/2009 | Whitlaw | A47G 25/90 223/111 |
| 2011/0119814 | A1 | 5/2011 | Caliste | |
| 2011/0315724 | A1* | 12/2011 | Whitlaw | A47G 25/90 223/111 |
| 2013/0270310 | A1 | 10/2013 | Santos | |
| 2016/0022078 | A1* | 1/2016 | Sclafani | A41F 11/16 2/315 |

* cited by examiner

*Primary Examiner* — Shaun R Hurley
*Assistant Examiner* — Andrew W Sutton

(57) ABSTRACT

An embodiment of an aid to help disabled persons use the bathroom independently. It includes a cord, attachable to a person's pants at its first end, and a loop which is affixed to the waistband of his or her underpants. The person inserts a clip which is at the second end of the cord through the loop, finally attaching the clip to a place where it may easily be reached, such as his shirt. When using the toilet, he may allow his pants and underpants to drop toward the floor, they being tethered to the cord and attached by the clip to his shirt. His hands may thereby remain free for necessary business. He may easily conclude by grasping the cord and pulling upward, retrieving his pants and underpants simultaneously, without having to bend over.

9 Claims, 4 Drawing Sheets

APPARATUS TO HELP DISABLED PERSONS PULL UP PANTS AND UNDERPANTS SIMULTANEOUSLY AFTER USING THE TOILET

CROSS-REFERENCE TO RELATED APPLICATIONS

This application claims the benefit of provisional patent application Ser. No. 62/207,424, filed 2015 Aug. 20 by the present inventor.

BACKGROUND

Prior Art

The following is a tabulation of some prior art that presently appears relevant:

| Pat. No. | Kind Code | Issue Date | Patentee |
|---|---|---|---|
| 8,087,707 | B1 | 2012 Jan. 3 | Hawkins |
| 6,044,491 | A | 2000 Apr. 4 | Emery |

| Publication Nr. | Kind Code | Publ. Date | Applicant |
|---|---|---|---|
| 2013/0270310 | A1 | 2013 Oct. 17 | Santos |
| 20090039118 | B2 | 2012 Jan. 10 | Whitlaw |
| 20050205619 | Al | 2005 Sep. 22 | Morel |
| 20040034902 | A1 | 2002 Aug. 22 | Yturria |
| 20110119814 | A1 | 2012 May 22 | Caliste |

An individual may become temporarily or permanently disabled due to surgery, ailment, injury, obesity, or old age. Lack of flexibility in the hips, knees, and back presents a challenge when one attempts to lower his pants and underpants, while keeping hold of them, in order to use the toilet, and especially when he must bend and reach to pull them up afterward. Some may be able to push their pants and underpants down, but have trouble keeping them within reach during elimination, and hence are unable to retrieve them without help once they've fallen toward their ankles.

There are various known devices in prior art for dressing individuals with disabilities. "Reachers", such as U.S. Pat. No. 8,087,707 issued to Hawkins, commonly assist the user by extending his reach toward clothing or items desired. These typically comprise a pole, controlled at one end by a handle and trigger mechanism, terminating at its opposite end in a jaw, hook, loop, or other modification specific to the task. Such devices are either carried by the individual, or must be made available to him if they are to be useful in the bathroom. These also command considerable manual dexterity and hand-eye coordination; and, in the event that the unit falls to the floor, it may become useless to the person who cannot bend to pick it up.

Other known accoutrements for dressing employ rods, loops, straps, sleeves, clamps, cords, wires, belts, and buckles, in various combinations to pull garments onto the lower half of the body, such as U.S. Pat. No. 8,091,748 to Whitlaw, 20050205619 to Morel, U.S. Pat. No. 6,044,491 to Emery, and 2013/0270310 to Santos. These must likewise be conveyed with, or be made available to the person with limited mobility at the time he or she wishes to use the toilet. In addition, application, manipulation, and removal of the rigging may require considerable effort and dexterity. And, again, should the user drop it, he may be unable to bend to the floor to pick it up, and would then be unable to raise his pants and underpants alone. Further, the cumbersome nature of such equipment may leave straps or belts dangling, impeding motion, or even becoming soiled during the process of urination/defecation. Additionally, the person with limited strength and coordination may need to perform multiple procedures with multiple devices in order to use the toilet.

Undergarments for handicapped persons offer panels and flaps to access the crotch area of an individual, such as US20040034902 to Yturria, and US20110119814 to Caliste. Many of these are fastened by means of hook and loop "VELCRO". Significant reaching and/or bending may present difficulty when attempting to detach, and then re-attach the strips in precise alignment. And proper positioning of the flap/panel during elimination is important, so that it does not interfere with urination/defecation, lest the garment be soiled. These procedures may be painful or even dangerous for a disabled person as he leans and bends to one side, while reaching under his buttocks from the opposite side. He may even arch his hips upward to raise his entire posterior from the seat in order to re-engage flaps or panels, and he must still find a way to retrieve his pants after manipulating the undergarment.

Many useful advancements have been made available to help physically impaired ones dress and undress. However, there is a need for help specifically in the area of using the toilet, as many of the previously described items are inefficient or ineffective in this area.

Advantages

The following advantages, therefore, have been considered in one or more foregoing aspects of an apparatus for lowering and raising pants and underpants simultaneously:

- One which is small, lightweight, and capable of being worn comfortably and inconspicuously on the body, so that no cumbersome equipment need be carried to the bathroom.
- One which is safely operated without assistance, without attaching and removing multiple devices, and without fear of dropping tools that cannot be retrieved from the floor.
- One that is inexpensive and easily applied to a person's existing wardrobe with no required fitting, measuring, or sizing, and doesn't require substantial strength, dexterity, reaching, leaning or bending.
- One which allows both hands free while using the toilet to gather paper, wipe, hold a grab bar, position a walker, etc., without fear of losing hold of one's pants and underpants.
- An apparatus that will not interfere with a person's motion, nor be in a position to become soiled as one uses the toilet.

What is needed is an apparatus that offers several of the advantages described herein, and/or solves one or more problems that may come to the attention of one skilled in the art upon his or her becoming familiar with this specification.

DRAWINGS—FIGURES

Figure 1:
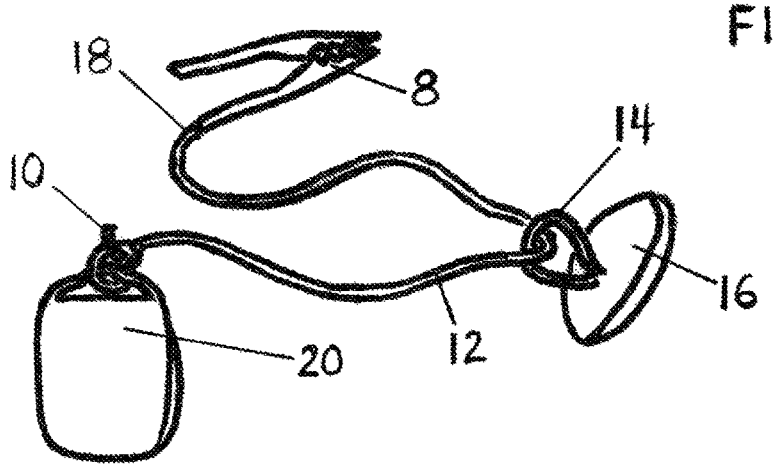
FIG. 1 shows a plan view of an embodiment of the apparatus.

| Drawings - Reference Numerals | | | |
|---|---|---|---|
| 8 | clip | 30 | barbed stud |
| 10 | first end of cord | 32 | catch for barbed stud |
| 12 | cord | 34 | v shaped stabilizer |
| 14 | loop | 36 | receiver for v shaped stabilizer |
| 16 | snap | 40 | ribbed spike |
| 18 | second end of cord | 42 | catch for ribbed spike |
| 20 | clamp | 44 | convex stabilizer |
| 22 | waistband of pants | 46 | concave receiver |
| 24 | waistband of underpants | 48 | bar |
| 26 | shirt | 50 | notch |

DETAILED DESCRIPTION—FIGS. 1-6

Figure 2:
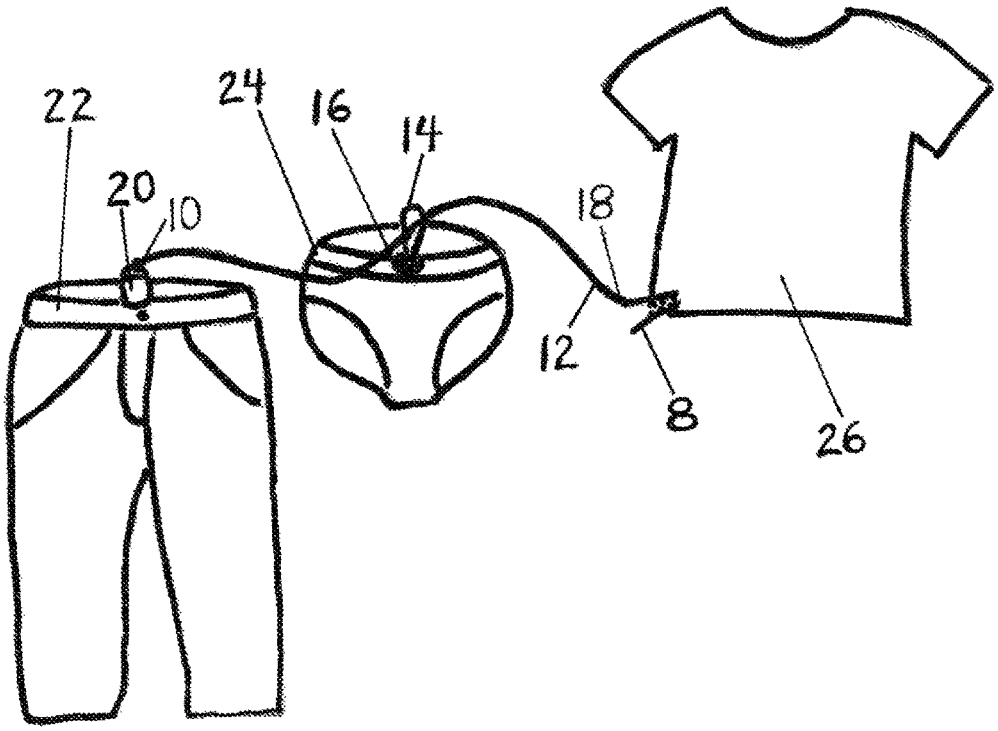
FIG. 2 shows the apparatus of FIG. 1 attached to clothing.

FIGS. 1 and 2 show an embodiment of the apparatus. It includes a cord 12 about sixteen inches long, attachable at its first end 10 to the waistband of pants 22, by way of a suspender clamp 20. The second end 18, of the cord 12 is attachable to a shirt 26 by use of a clip 8. Between the two ends 10, 18 of the cord 12 is a person's underpants, a snap 16 attached to its waistband 24. A loop 14 or ring is protruding from the snap 16, and is encircling the cord 12.

The cord 12 is comprised of a slightly stretchable material such as a polyester/spandex blend. Many other types of cord or strap may be used, such as parachute cord, natural fibers like cotton, and combinations of natural and synthetic materials.

The clip 8 illustrated is essentially an alligator clip, typically made of metal, and crimped onto the second end 18 of the cord 12. However, clips and fasteners of many materials, shapes, and sizes are available commercially and may be suitable for connection to the second end 18 of the cord 12. Also, a variety of means in addition to crimping are acceptable for attaching the cord 12 to the clip 8. Some include, but are not limited to tying, gluing, sewing, using an intermediary ring, and multiple other connective means.

The suspender clamp 20 is shown tied to the first end 10 of the cord 12. This type of clamp 20 is one option for accomplishing a secure, yet removable grip on the waistband of one's pants 22. Clamps come in various shapes, strengths, compositions and colors which may provide adequate adherence to ones pants, shorts, or skirt. Direct sewing of the cord 12 to the pants 22, is a simple means of attachment. Also, an intermediary connector between the first end 10 of the cord 12 and its means of attachment to the pants 22 may be chosen from a wide range of connective materials and fasteners.

On the front of the underpants 22 is the loop 14. I currently prefer the loop be of elastic or similar material having a rebounding quality and capable of being laundered repeatedly. I contemplate presently that round elastic, approximately 2 mm to 5 mm thick, or braided ¼ inch (0.6 cm) wide, will provide the quality of strength while also being capable of gliding smoothly along the cord 12. It is foreseen that other satisfactory components could likewise comprise the loop 14, or similar appendage on the waistband 24 for the cord 12 to slide through. Other textiles, bands, eyelets, and the like are possibilities, as would be a rigid component like a ring of plastic, metal or wood, etc. The loop 14 may be simply attached to the waistband of underpants 22 by means of a connection such as sewing, gluing, or by other fastening means. But I presently contemplate an advantage, in at least one embodiment, of having the loop 14 attachable by means of a plastic, or composite, snap 16.

I presently see the snap 16 as being round, about ⅛ to ½ inch (0.3 to 1.2 cm) thick, once the two halves are pressed together. It being approximately ½ to 1 inch (1.2 to 2.5 cm) in diameter, but other shapes and dimensions are also anticipated. I presently prefer it be made of plastic or similar non-ferrous material, safe for wearing in an MRI machine. It may, optionally, be comprised of other commonly used materials.

Figure 5:
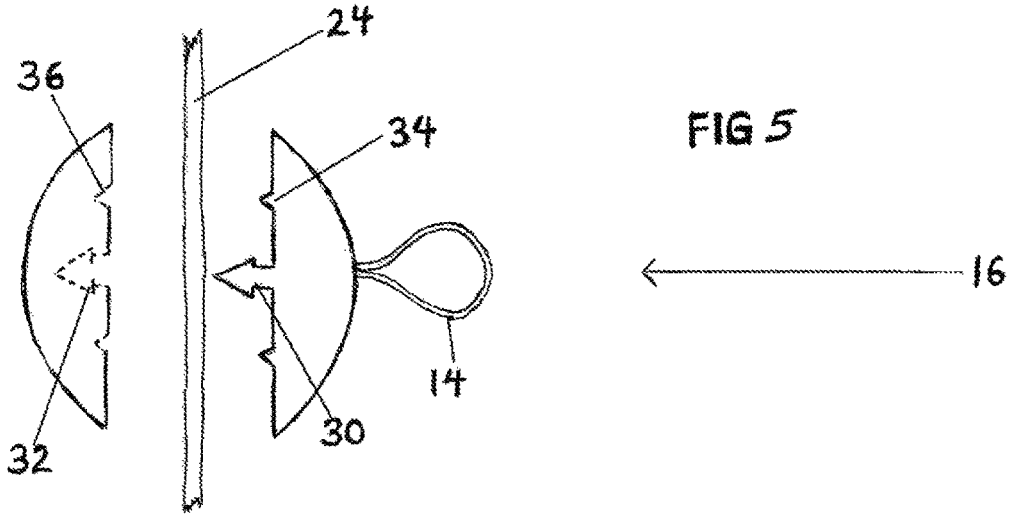
FIGS. 5 and 6 are side views of aspects of snap and loop configurations.
Figure 6:
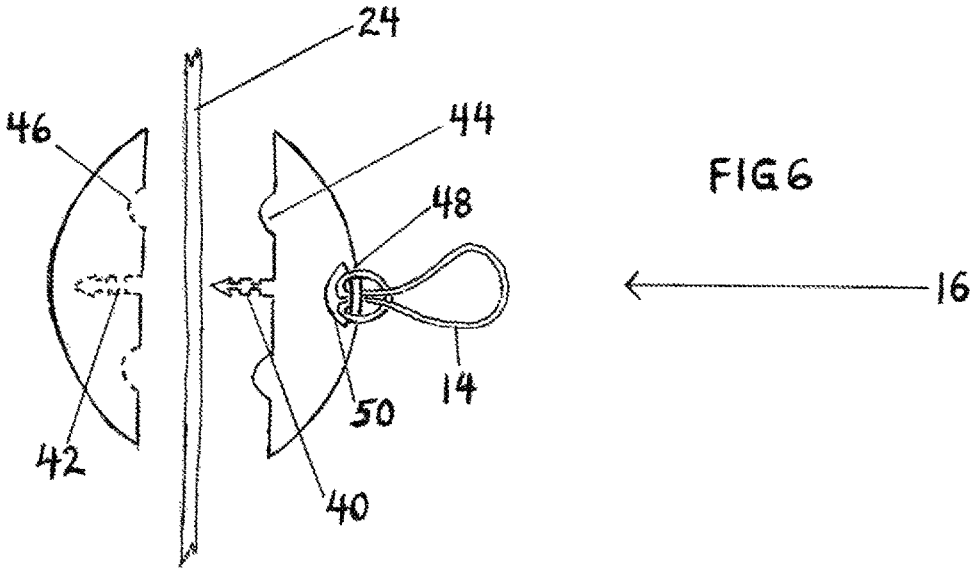

FIGS. 5 and 6 show snaps 16 which may compose an embodiment. They consist of two crescent-shaped, or saucer-shaped halves. One half of the snap 16 may contain a barbed stud 30, or a ribbed spike 40 capable of penetrating the waistband of underpants 24. The opposite half of the snap embodies a catch 32, 42 which receives and interlocks with the stud 30 or spike 40. Stabilizers 34, 44 prevent the snap 16 from spinning on the waistband 24 and causing a tear. In FIG. 5 the snap 16 is manufactured in such a way as to contain the loop 14 imbedded within one of its halves, such as by injection molding. This half of the snap 16 also encompasses a barbed stud 30 and v-shaped stabilizers 34. Its opposite half contains a receiving and interlocking catch 32, as well as corresponding v-shaped receivers 36 for the v-shaped stabilizers 34. The purposeful parts of the snap 16 may be contained in either of its halves and in optional configurations and combinations. More than one stud 30 or spike 40 could be advantageous. Stabilizers 34, 44 may take many optional forms: A ring-shaped groove may receive a ring-shaped ridge, or the stud 30 could itself be mounted onto a square block, and received into a square cavity on the opposite half of the snap 16, etc.

In FIG. 6 the protrusion for piercing fabric is a ribbed spike 40. It is housed within the half of the snap 16 which also contains convex stabilizers 44. The opposite half of the snap 16 receives the ribbed spike 40 into its catch 42, encircling and securing its ribs. It also contains the corresponding concave receivers 46 for the convex stabilizers 44. This example of the snap 16 shows the loop 14, not imbedded within the half of the snap, but being attached later. Half of the snap 16 has been produced with a slot or notch 50. A bar 48 is seen spanning the notch 50. The loop 14 may be slipped under the bar 48 and pulled through itself, as in FIG. 6, or be tied to the bar 48, etc. The purposeful parts of the snap may be contained in either of its halves, and in multiple and various combinations.

Other processes and measures may be employed to produce an arrangement that would either contain the loop 14 or allow it to be mounted onto the snap 16. Ultrasonic welding, per my conversation with Parker Plastics, 3585 Valley Dr. Pittsburgh, Pa. 15234, is one of several options if I cannot find a suitable snap already commercially available. A myriad of configurations are possible. For example, the loop 14 may first be imbedded into an allotment of substrata, and then enclosed within half of the snap 16 in a separate process. The loop 14 may alternately be push through an opening in one half of the snap's inside surface. The bulk of the loop 14 could protrude from the opening, with an anchor on the loop 14 preventing it from slipping completely through the opening. Various other appendages, comparable to the loop 14, attachable to underpants 24, and capable of sliding on and surrounding the cord 12 are foreseen.

Figure 3:
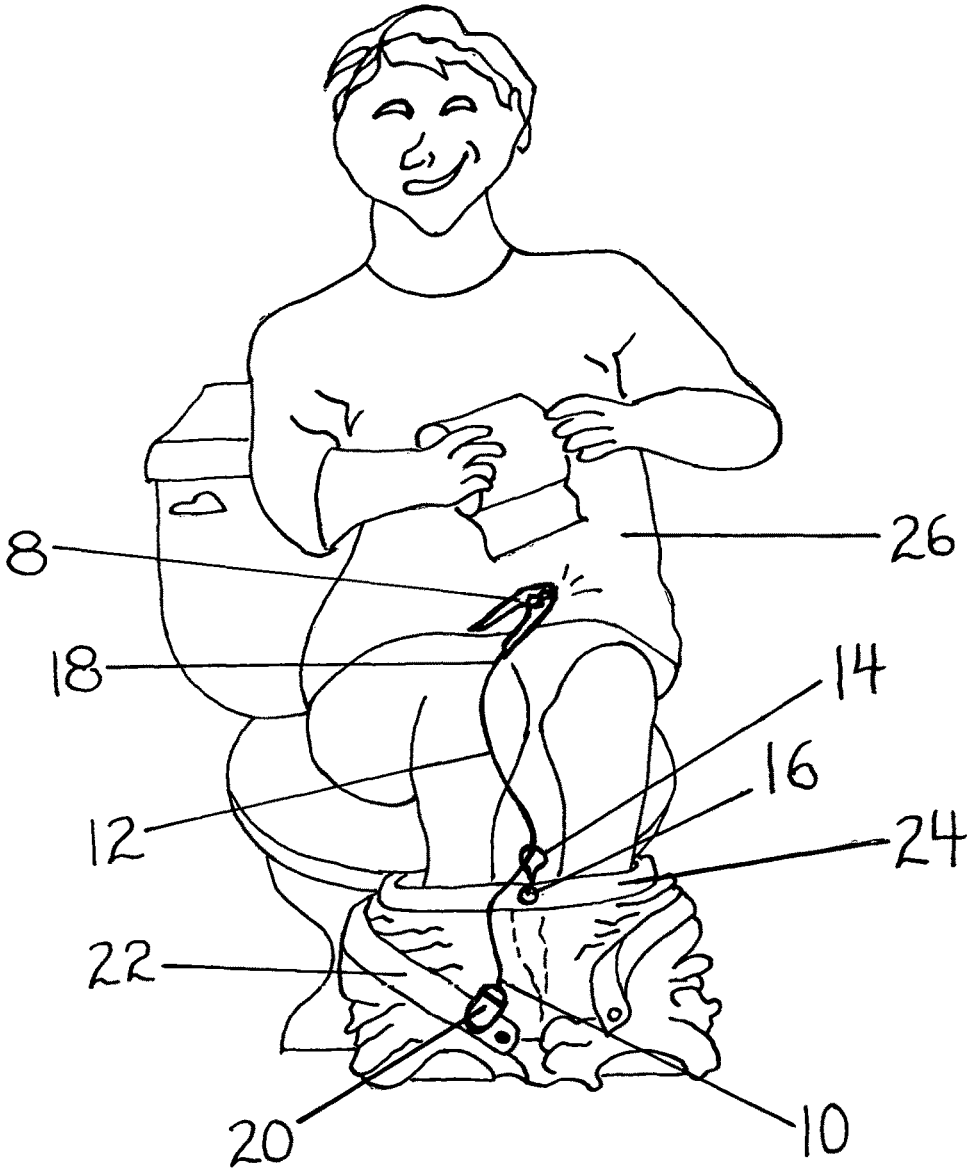
FIG. 3 is a perspective view of the embodiment of FIG. 1 and FIG. 2 as used to retain pants and underpants while a person uses the toilet.
Figure 4:
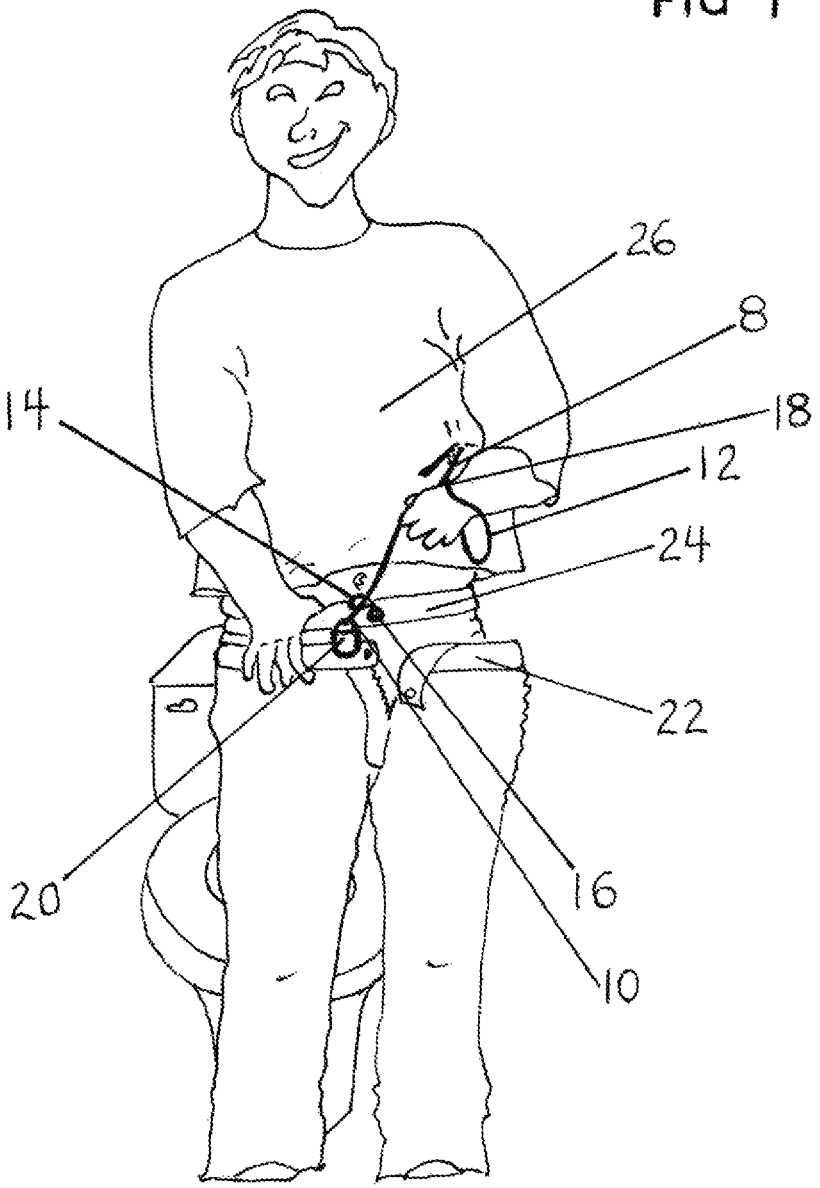
FIG. 4 is a perspective view of the embodiment of FIGS. 1 and 2 as used by an individual to raise pants and underpants simultaneously after using the toilet.

Operation—FIGS. 2,3,4

In operation, a person will attach the snap 16 containing the loop 14 to his underpants 24. He may well do this while wearing them. He will push the half of the snap 16 containing the stud 30 through the waistband of his underpants 24. He will position the other half of the snap 16 containing the catch 32 against the opposite side of the waistband 24. The loop 14 facing away from him, he will press the two halves toward and into one another until the stud 30 has interlocked with its catch 32. This will form a secure, permanent attachment to the waistband 24. No tools or peening are necessary to apply the snap 16. Multiple snaps can be added easily and inexpensively to a person's existing supply of underpants, and can be laundered as usual. Those requiring MRI's may have the option of leaving their underpants on, since the snap in this aspect does not contain ferrous metal.

According to FIG. 2, the person will proceed to attach the suspender clamp 20, at the cords first end 10 to the waistband of his pants 22. Next, he will grasp the alligator clip 8 at the second end 18 of the cord 12, insert it through the loop 14, and attach it to a portion of his shirt 26, for example, the inside, the outside, or the bottom edge of his shirt 26. He may optionally choose to tuck the alligator clip 8 and excess cord 12 into his pants pocket once he's dressed, until such time that he needs to lower his pants. Since the apparatus is not cumbersome, but lightweight and inconspicuous, it can remain on his clothing throughout the day.

In FIG. 3, the person has lowered his pants and underpants in order to use the toilet. His pants 22 and underpants 24 are tethered by the cord 12. The second end 18 of the cord 12 remains attached to his shirt 26, leaving both of his hands free for necessary business.

In FIG. 4, the person has finished using the toilet. He is drawing both his pants and underpants upward simultaneously, by grasping the cord 12 and pulling it upward toward his waist. He does not need to bend his knees, hips, nor his back in order to easily reach his pants 22 and underpants 24.

The whole apparatus is compact, lightweight, and discreet. It is effective for physically impaired ones who wish to use the toilet independently, in a manner which preserves their dignity. Many infirm ones have help dressing and undressing in the morning and evening, but require help throughout the day, primarily for visits to the bathroom. These may save on expensive nursing or in-home care. Moreover, those with limited mobility will not need to fetch and carry cumbersome equipment to the bathroom, nor will they need to bend, lean or strain to use the toilet, thus minimizing fatigue and frustration.

CONCLUSION, RAMIFICATIONS, AND SCOPE

Thus, the reader will appreciate that the aid described herein provides much needed practical help to persons suffering various degrees of physical deterioration. While my above descriptions and illustrations exemplify embodiments of my apparatus, these should not be construed as limited to the precise configurations and resources described and illustrated. Other uses of the embodiments, or components thereof, are foreseen. For example, one may wish to tie a knot or loop in the cord for grasping. She may add a decorative grip or handle to make grasping and pulling the cord more effortless. A toy, trinket, or medical identification tag may be added to the cord. A large person may add an additional clamp, attaching it to the main cord by a short piece of cord, to span her width. The cord may be retracted by mechanical means to pull pants and underpants up. The cord may be shortened or lengthened. The second end of the cord may be customized by adding to, or replacing the clip. Another fastening means, such as a hook, a ring, "VELCRO", or suction cup, for example, could modify the cord's end so that it may be fastened to something other than a garment. In this way a towel bar, a wheelchair, or other object within reach could retain the end of cord while one uses the toilet.

The cord, with its attaching means at its ends may be used alone, without the snap and loop. One might keep an upper body garment, scarf, or hat from blowing away on a windy day, or hold a baby's bib down. The clamp, attached to a purse, could provide easy access to items inside the purse, such as keys or pepper spray. Ones wearing medical devices could keep them from migrating from their proper places. Or one may keep something hidden, attached to the clip, inside his shirt.

The snap with its loop may be put to various other uses independent of the cord, such as: binding any two fabrics together to form a pocket or strap while backpacking, mending a tarp, tent, or blanket when camping; college kids could form a simple sheet into a curtain without even removing the curtain rod from the window. By gluing, or otherwise attaching one half of the snap to a desired surface, one could effectively add any fabric, plastic, or paper to that surface. Snaps could be produced in varying sizes and strengths, made more flexible at their edges and more rigid at their centers, to accommodate different thicknesses and varieties of materials. A fastener could be applied to the snap in place of the loop. Snaps could be decorative themselves by painting or gluing things to them, could be used in scrapbooks, or to hang items like kitchen towels, or move a button hole on a pregnant woman's pants, etc.

Thus, various other modifications and changes will be apparent to those skilled in the art, and may be made in the arrangement, operation, and details disclosed herein, without departing from the scope as outlined in the claims and their legal equivalents.

I claim:

1. An apparatus for assisting disabled persons and those with limited mobility in using the toilet by facilitating the lowering and raising of pants and underpants simultaneously, comprising: a length of cord having a first end and a second end, each terminating in a means for attachment to fabric; and a loop, capable of being attached to the waistband on underpants; wherein said first end of said cord attaches to the waistband on pants; said second end of said cord passes through said loop, and is attachable to a place on the upper torso, on a shirt.

2. Apparatus of claim 1, wherein said first end of said cord is attachable to pants by means of sewing, gluing, or a means selected from the group consisting of clamps, clips, and fasteners.

3. Apparatus of claim 1, wherein said second end of said cord is attachable to the shirt by a means selected from the group consisting of clamps, clips, and fasteners.

4. Apparatus of claim 1, wherein said loop is elastic.

5. Apparatus of claim 1, wherein said loop is attachable to the waistband of underpants by means of sewing, gluing, or a means selected from the group consisting of snaps and fasteners.

6. Apparatus of claim 5, wherein a snap is of plastic, and is comprised of a first half containing a means for penetrating the waistband on underpants; and an opposing second half, containing means of receiving and interlocking with the penetrating means of said first half, both halves thereby sandwiching the waistband on underpants, forming a secure attachment once firmly pressed together.

7. Apparatus of claim 6, wherein respective halves of the snap contain on their inner surfaces one or more means for stabilizing the snap in its attachment to the sandwiched waistband, a protruding convex portion on one half of the snap, and a corresponding concave portion on the opposing half of the snap.

8. Apparatus of claim 6, wherein the loop is incorporated within, or attachable to the snap.

9. Method for assisting persons of limited mobility in using the toilet by facilitating the lowering and raising of pants and underpants simultaneously, comprising: attaching a first end of a length of cord to a waistband on pants, inserting a second end of said cord through a loop protruding from a waistband on underpants, attaching said second end of said cord to a location easily reached; further comprising: the lowering of pants and underpants simultaneously in order to use the toilet by grasping pants and underpants and pushing them downward, underpants remaining attached to pants during use of the toilet, being conjoined by said cord, said cord remaining attached to a location within reach throughout elimination; and further comprising: retrieval of pants and underpants simultaneously by grasping said cord, drawing it upward, the underpants gliding along said cord by means of the loop, thereby being raised in unison with pants to a position where both can easily be reached.

* * * * *